United States Patent [19]

Falce

[11] 4,165,473

[45] Aug. 21, 1979

[54] ELECTRON TUBE WITH DISPENSER CATHODE

[75] Inventor: Louis R. Falce, Redwood City, Calif.

[73] Assignee: Varian Associates, Inc., Palo Alto, Calif.

[21] Appl. No.: 800,837

[22] Filed: May 27, 1977

Related U.S. Application Data

[63] Continuation-in-part of Ser. No. 697,905, Jun. 21, 1976, abandoned.

[51] Int. Cl.[2] ..... H01J 1/14; H01J 14/06

[52] U.S. Cl. ..... 313/346 R; 252/514; 252/521; 313/337; 313/346 DC

[58] Field of Search ..... 313/346, 337, 336, 346 R, 313/346 DC; 252/514, 521

[56] References Cited

U.S. PATENT DOCUMENTS

| | | | |
|---|---|---|---|
| 2,902,620 | 9/1959 | Winter | 313/346 |
| 3,139,541 | 6/1964 | Henderson et al. | 313/346 |
| 3,155,864 | 11/1964 | Coppola | 313/346 |
| 3,437,865 | 4/1969 | Gabor et al. | 313/346 |
| 3,497,757 | 2/1970 | Zalm et al. | 313/346 |

*Primary Examiner*—Saxfield Chatmon, Jr.
*Attorney, Agent, or Firm*—Stanley Z. Cole; Gerald M. Fisher; Robert B. Block

[57] ABSTRACT

The performance of microwave tubes at very high frequencies is limited by the ability of their thermionic cathodes to provide high emission current density in combination with long life and low evaporation of active material. An improved tube uses a cathode comprising a porous metal matrix consisting of a compacted mixture of tungsten and iridium particles, impregnated with a molten barium aluminate. Other alkaline earth oxides may be used as additives. The impregnated cathode outgasses easily and has a long life because it is not dependent on thin surface films. Thermionic emission is improved compared to a tungsten matrix, and barium evporation is reduced. The combination of power and frequency obtainable from the microwave tube is thereby significantly increased.

11 Claims, 12 Drawing Figures

ELECTRON TUBE WITH DISPENSER CATHODE

This is a continuation-in-part of application Ser. No. 697,905 filed June 21, 1976 now abandoned.

FIELD OF THE INVENTION

The invention pertains to thermionic electron tubes, particularly at very high frequencies, and their performance as related to their thermionic cathodes.

The power generated by electron tubes at very high microwave frequencies has in many sets of operational parameters been limited by the thermionic emission density which can be obtained from the cathode. In tubes designed for continuous-wave operation, the most suitable cathodes are quite different from the oxide-coated cathode usually used for short-pulse operation, and the requirements are much more severe.

The exact scaling laws for tube capability are not easily defined, but some power-laws are easily derived. For example, in a linear-beam tube with fixed values of perveance and area convergence of the electron beam (which are both limited by design considerations) the maximum microwave power output is proportional to the fifth power of the current density. Therefore, doubling the emissivity of the cathode will permit a 32-fold increase in power in the frequency range where emission is the limiting factor.

PRIOR ART

Thermionic cathodes have long been known comprising a metal matrix with pores containing active oxide material, particularly barium oxide. Such cathodes have been made by pressing mixtures of nickel powder and alkaline earth carbonates ("mush" cathodes). These cathodes are heated in the electronic tube in which they are used, to break down the carbonates into oxides, with evolution of much carbon dioxide and consequent difficulty in evacuating the tube. Mush cathodes have given somewhat improved continuous emission at higher current densities than the traditional oxide-coated cathode. At their operating temperature the vapor pressure of nickel is marginally high.

For cathodes delivering emission currents of one ampere or more per square centimeter continuously, it has been found desirable to provide a continuous matrix of metal to carry the high currents.

The dispenser "L" cathode used a matrix of tungsten particles sintered together. In a cavity inside the matrix was a charge of barium oxide (formed by breaking down barium carbonate). In operation, barium oxide and free barium reduced by reaction of the oxide with tungsten, diffuse to the surface of the porous tungsten body and activate it for thermionic emission. The "L" cathode has been of only limited use, due to some inherent difficulties. The enormous exposed surface of the porous tungsten and the tortuous diffusion paths through its pores, result in an evolution of gas from the oxide charge and from the porous body itself which takes a very long time to pump out. Furthermore, the operating temperature of the "L" cathode is high, e.g. over 1100 degrees Celsius. This temperature makes the reliability and life of insulated heaters become poor.

Numerous attempts have been made to impregnate barium oxide directly into the pores of a porous metallic matrix. It was found that molten barium oxide reacted with the tungsten and poisoned the cathode.

An improved impregnated cathode is described in U.S. Pat. No. 2,700,000 issued to R. Levi et al on Jan. 18, 1955. This patent teaches that if the barium oxide is combined with aluminum oxide to form a barium aluminate the molten mixed oxide can be impregnated into a tungsten matrix without reaction with the tungsten to form the harmful barium tungstates.

U.S. Pat. No. 3,201,639 issued Aug. 17, 1965 to R. Levi further teaches that addition of the oxide of a second alkaline earth element such as calcium improves the emission qualities of the impregnated cathode. With these cathodes emission of one ampere per square centimeter has given very long life and successful operation at 3 amperes per square centimeter has been achieved. To increase emission one runs at higher temperature with consequent increased evaporation of active material and shorter life of the tube—due to both depletion of the cathode and contamination of other parts such as insulators by the evaporated material.

In the article "High Power Sources at Millimeter Wavelengths" by D. C. Forster, Proceedings of the IEEE, vol. 54, no. 4, Apr. 1966 page 533 there is described the "technological limitation" of 3 amperes per square centimeter dc as the best available in millimeter wave tubes.

U.S. Pat. No. 3,373,307 issued November 12, 1964 to P. Zalm et al teaches that coating the emissive surface of a barium aluminate impregnated tungsten cathode with metallic osmium can increase the thermionic emission at a given temperature or, conversely, reduce the temperature for a given emission density, at which reduced temperature the evaporation of active material from the emissive surface is reduced and the life of the tube prolonged. Other elements claimed to have similar emission-enhancing properties are ruthenium, iridium and rhenium. U.S. Pat. No. 3,497,757 teaches the use of alloys of these metals, particularly alloys of osmium. The exact mechanism of emission enhancement by an osmium layer is not well understood. It is believed that the osmium has surface attractive forces which hold activating barium atoms tightly and polarize these atoms to produce a reduced work function. Such osmium layers have been produced by sputtering a thin film onto the cathode emissive surface. There are several disadvantages of the osmium-film coated impregnated cathode. Osmium is known to form a volatile oxide which is a very dangerous poison. Also, in operation, the osmium layer may be removed by electric arcs reaching the cathode surface or by sputtering away of the cathode surface as the result of bombardment by high-energy positive ions which are always produced in a high-power tube by electron collisions with gas molecules. It also appears probable that the thin coating may diffuse slowly into the cathode body. At any rate, with long operation these cathodes lose activity and revert to the properties of ordinary impregnated cathodes.

Experiments at the U.S. Naval Research Laboratories have shown promising results with a cathode consisting of a matrix of pure iridium containing barium oxide in its pores. It has been suggested by NRL that a mixture of tungsten and iridium may provide equal results at less cost. In the NRL experiments, the matrices were infiltrated with water-soluble alkaline earth salts such as Ba:Ca:Sr acetate mixtures. The matrix was then dried and fired at high temperature to break down the acetates to oxides. Applicant has made cathodes according to the NRL teaching. He has found that the decomposition products of the soluble organic compounds dispersed in the pores of the matrix exude as gases for an impractically long time. Also, since the resulting oxide is less than the acetate solution, the pores are only partly filled with oxide.

SUMMARY OF THE INVENTION

An object of the invention is to provide a vacuum tube with substantially increased electron current density.

A further object is to provide an electron tube having substantially increased life.

A further object is to provide an electron tube which may be speedily outgassed.

A further object is to provide a tube whose reliability is not degraded by cathode-to-anode arcs.

A further object is to provide a tube for generating increased power at microwave frequencies.

A further object of the invention is to provide an improved thermionic cathode capable of emitting higher current density than previously available cathodes.

A further object is to provide a cathode having 10 amperes per square centimeter cw emission.

A further object is to provide a cathode which will outgas readily.

A further object is to provide a cathode with long life and low rate of evaporation of active material.

A further object is to provide a cathode which is resistant to degradation by arcs and ion bombardment.

To achieve these objectives, the tube incorporates a thermionic cathode comprising a porous metallic matrix in which iridium is a bulk constituent instead of merely a surface layer. The matrix is completely impregnated with a molten alkaline earth aluminate. The resulting complete filling of the pores of the matrix provides a structure which outgases quickly. A matrix composed of a mixture of particles of iridium and tungsten has been found good and other metals such as molybdenum, mixed with iridium may be used. However, a matrix of pure iridium is an alternate embodiment. The metallic particles are pressed and lightly sintered. Heating only to the temperature required to impregnate may be sufficient to sinter. The impregnant is primarily barium aluminate. Alternatively, lesser quantities of other alkaline earth oxides may be added to the barium aluminate. It has been found that tubes embodying these cathodes can be operated with up to 10 or more amperes per square centimeter emission current density compared to 3 amperes for prior art cathodes. Thereby the power produced at high microwave frequencies may be increased many fold.

Figure 1:
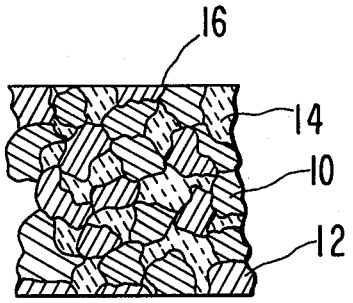
FIG. 1 is a schematic cross-section of a portion of a cathode emitter according to the invention.
Figure 2:
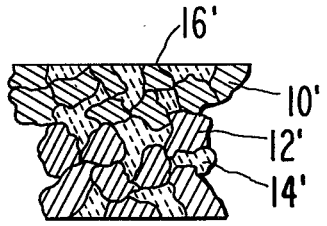
FIG. 2 is a schematic cross-section of a portion of an alternate embodiment.

For clarity, the particle sizes in FIGS. 1, 2 and 3 are shown much larger in relation to the cathode dimensions than would be used in practice.

DESCRIPTION OF THE PREFERRED EMBODIMENTS

In FIG. 1 the structure of a cathode according to the present invention is schematically illustrated. The cathode comprises particles 10 of pure iridium randomly mixed with particles 12 of pure tungsten. The metal particles are preferably from 2 to 8 micrometers in dimensions. The metal particles form a continuous matrix with preferably 20 to 25% porosity. The metal particles contact each other and are preferably bonded as would result from pressing and a small degree of sintering. Some alloying of the different metals is of course present, but it is believed that optimum results require the alloying to be incomplete. The pores in the metal matrix are substantially filled with alkaline earth aluminate active material 14. Smooth emissive surface 16 is formed by machining the metallic matrix before it is impregnated as discussed below in connection with FIG. 3.

The physical and chemical nature of the operation of the cathode of FIG. 1 is not well understood. With previous cathodes coated with metals of the group consisting of osmium, iridium and rhenium, it was believed that the emissive surface should be completely formed of these materials to the exclusion of tungsten. However, applicant has found that mixtures of iridium particles with tungsten particles can provide enhanced emission, even exceeding the emission from a pure iridium matrix. Mixtures with as little as 10% of expensive iridium are believed to be effective, while around 20% seems to be optimum. It would thus appear, surprisingly, that an iridium coating of the emissive surface is not required and that the iridium can produce its benefits when dispersed as a bulk constituent of the metallic reflux. Thus, the essential iridium is not lost by sputtering away of the emissive surface by positive ion bombardment of by arcs striking the cathode of by diffusing away into its bulk. Loss of barium from the emissive surface is quickly replenished by diffusion from the underlying oxide-filled pores.

An operating test on a cathode as illustrated in FIG. 1 containing 50% iridium showed that after 200 hours of operation at 1050 degrees C. brightness temperature, the inventive cathode had a completely space-charge limited emission of 10 amperes per square centimeter compared to a standard tungsten impregnated cathode in an identical test vehicle which provided only 5 amperes per square centimeter.

FIG. 2 illustrates another embodiment of the invention wherein the iridium particles 10' are concentrated near the emissive surface 16' of the cathode. The deeper layers of the cathode here are made of tungsten particles only. In this way, the amount of expensive iridium is minimized while in the region near the surface which is believed to determine the emissive properties, the concentration of iridium is high. Such a structure may be fabricated by introducing the metallic particles into the compression mold in suitable layers.

FIG. 3 illustrates the steps in producing a cathode such as depicted in FIG. 1. FIG. 3*a* illustrates schematically a cross-section of a mixture of particles of iridium 10 and tungsten 12 as placed in a mold. The particles touch each other at points only.

Figure 3A:
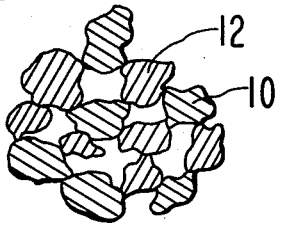
FIGS. 3*a*–3*e* illustrate the steps in fabricating the cathode of FIG. 1.
Figure 3B:
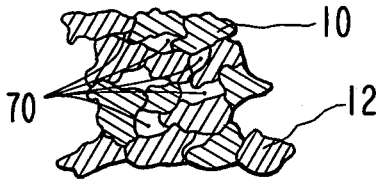

FIG. 3*b* shows the mixture after pressing with, for example, 50,000 psi. The mixture has been compacted into a relatively dense but porous solid body having interstices 70. Contacts between particles 10, 12 have enlarged to form abutting surfaces.

Figure 3C:
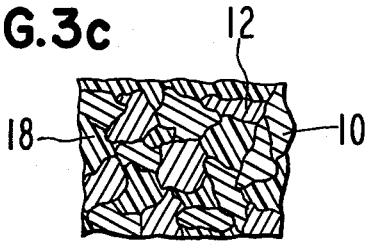

In FIG. 3*c* the porous matrix has been impregnated with a polymerizable organic monomer liquid 18 such as methyl methacrylate, and the structure is heated to polymerize the organic material 18 to form a solid, dense mass.

Figure 3D:
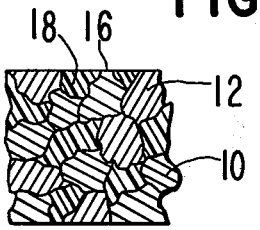

In FIG. 3*d* the impregnated body has been machined to provide smooth surfaces 16 to the exact dimensions required. The plastic impregnant 18 serves to hold the particles 10, 12 so that the body can be machined. The use of organic impregnant in machining matrix cathodes is described in U.S. Pat. No. 3,076,916, issued Feb. 5, 1963 to O. G. Koppius.

Figure 3E:
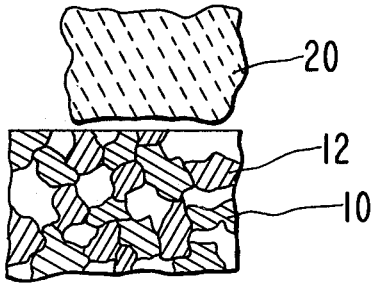

In FIG. 3*e* the plastic monomer 18 has been removed, as by evaporation at high temperature, and a body 20 of alkaline earth aluminate has been put on top of the matrix in preparation for its final, activating impregnation. The aluminates have been previously fused to form a uniform mixture. The result of the final step is shown in FIG. 1 where the aluminate 20 has been melted and has flowed by capillary attraction to fill the pores 14 in the matrix. Surplus aluminate has been mechanically removed from the emissive surface 16.

Figure 4:
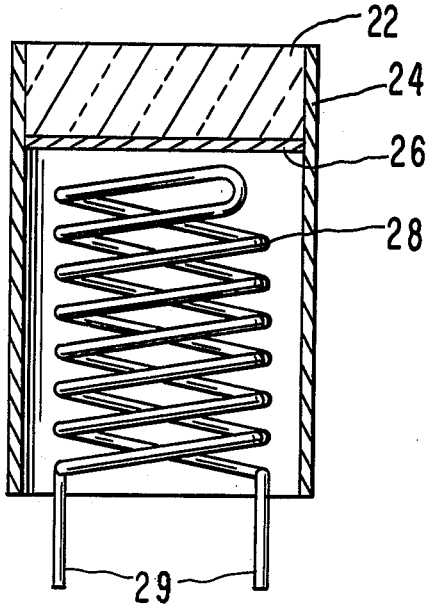
FIG. 4 is a section view of a complete cathode emitter.

FIG. 4 is a sectional view of a complete buttonshaped cathode. The active metallic matrix 22 is contained in a cylindrical can 24 as of molybdenum with a transverse plate 26. A bifilar heater 28, as of tungsten wire, heats the cathode by radiation. Heater 28 may be self-supporting on its legs 29 as shown or may be coated with alumina insulation (not shown) and rest inside can 24. Plate 26 protects heater 28 from the active material. Matrix 22 may be pressed directly within can 24 or may be fabricated as described in connection with FIG. 3 and then inserted in can 24. Matrix 22 is impregnated with the molten oxide after mounting in can 24.

Figure 5:
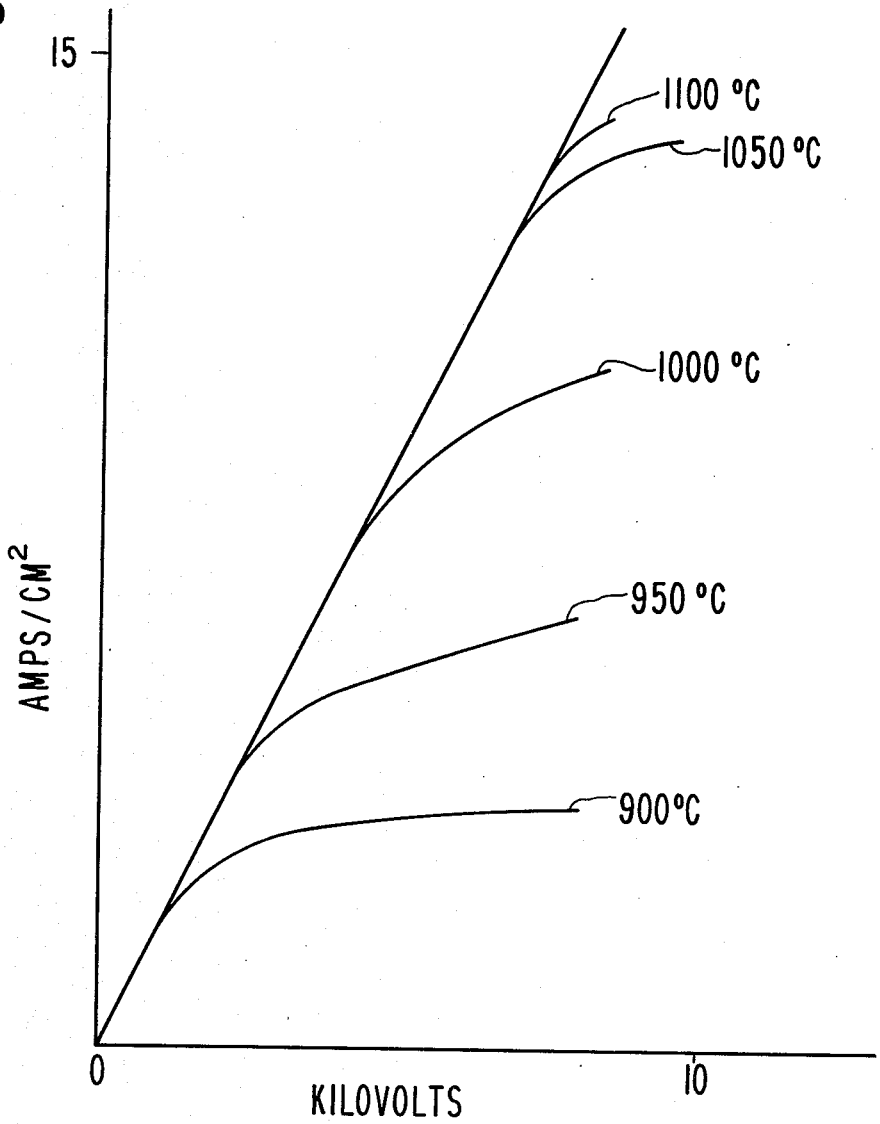
FIG. 5 is a graph of emission from an experimental cathode.

FIG. 5 shows the emission of experimental cathode #2 after 250 hours of life in a testing tube. This cathode had a matrix of 50% W, 50% Ir. Temperatures are brightness readings uncorected for a glass envelope.

The above examples illustrate structure and fabrication methods for particular cathodes used in the invention. It will be readily obvious to those skilled in the art that many other variations and embodiments are possible. For example, it is known that the elements osmium, ruthenium and rhenium all have properties very similar to iridium. At least the first two of these elements, or alloys thereof, may be substituted for the described pure iridium. Many formulations of alkaline earth aluminates have been found usable in impregnated cathodes, depending upon the particular properties desired.

In fabricating the inventive cathode, a further step may be inserted. That is, the compressed matrix may be sintered in vacuum or in a reducing atmosphere before being impregnated for machining. Sintering increases the density of the matrix and also its mechanical strength. Applicant has found that sintering at 1900 C. may be beneficial, but the temperature required for impregnating may be adequate. Applicant has found, however, that excess sintering will adversely affect the emissive properties.

Figure 6:
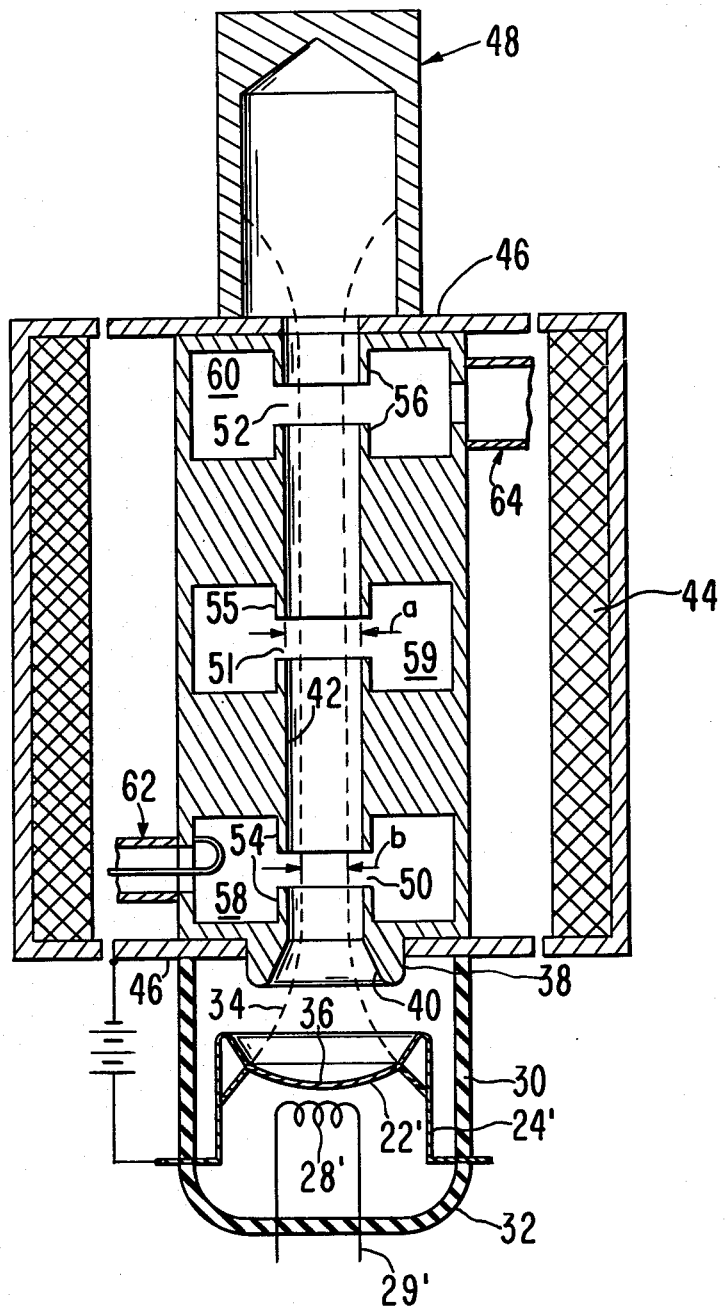
FIG. 6 is a schematic cross section of a klystron embodying the invention.

FIG. 6 illustrates schematically a klystron amplifier embodiment of the invention. A thermionic cathode emitter 22′ is supported by stem 24′ from an insulating bushing 30. Cathode 22′ is heated by radiation from a heater filament 28′ supported on legs 29′ from an insulating envelope seal 32. A stream of electrons 34 is drawn from the concave front surface 36 of cathode emitter 22′ by a voltage, positive to emitter 22′, on the anode 38. Electron beam 34 is converged by the converging electric field to a diameter b and passes through an aperture 40 in anode 38, whence it is transmitted through an interaction tunnel 42 having a diameter a. A solenoid magnet 44 provides axial magnetic field between iron polepieces 46 to keep electron beam 34 focused in a cylindrical outline. After leaving the magnetic field, beam 34 expands by its own repelling space-charge forces and is intercepted by a metallic collector 48.

Spaced along drift-tube 42 are interaction gaps 50, 51, 52 which are formed between re-entrant noses 54, 55, 56 of hollow metallic cavities 58, 59, 60 which are resonant at frequencies near the desired operating frequency. The first cavity, 58, is excited via a coupled transmission line 62 from an external signal source (not shown). The resulting resonant electric field across gap 50 produces velocity modulation of beam 34. As the beam passes through drift tube 42 the velocity modulation produces bunches of electrons, i.e. current modulation. Intermediate "floating" cavity 59 is excited by the current modulation and produces in turn increased velocity modulation. The amplified ac component of current induces wall currents in output cavity 60, whence amplified microwave energy is extracted through a coupled output waveguide 64.

The power generated by a tube such as the klystron of FIG. 6 is of course limited to a value less than the dc power in the beam, from which the microwave power is converted. The diameter b of beam 34 must be less than the diameter a of drift tube 42. In practice, $b=\frac{2}{3}a$ is a typical value.

Drift-tube diameter a must be small enough to efficiently couple the microwave electric fields to beam 34. Thus, its maximum diameter is determined by the electronic wavelength $\lambda_e$ of the beam, that is the distance the beam electrons travel in one radio-frequency cycle. In practice $a=\frac{1}{4}\lambda_e$ is about the feasible maximum whence $b=1/6\ \lambda_e$ In a beam with a velocity $v_e$ below the relativistic range the electron velocity is given by $$v_e=(2e/m)^{\frac{1}{2}}V^{\frac{1}{2}}$$

where e/m is the charge-to-mass ratio of an electron and V is the accelerating dc voltage. Also $$\lambda_e=v_e/f$$

where f is the microwave frequency whence $$b=\frac{(2e/m)^{\frac{1}{2}}}{6f}V^{\frac{1}{2}}$$

The total beam current $$I=\frac{\pi}{4}b^2 i_o=\frac{\pi e}{72mf^2}i_oV$$

where $i_o$ is the current density, limited by the cathode emissivity. The beam power is thus $$P = IV = \frac{\pi e}{72mf^2} i_o V^2$$

The relation between I and V in a space-charge limited discharge is given by the perveance $k = I/V^{3/2}$ In practice the useful range of perveance is limited by gun design difficulties and the required bandwidth of the tube. In very high frequency tubes a representative value is $k = 10^{-6}$ amperes/volt$^{3/2}$ Combining with the expression for beam current $$K = \frac{\pi e}{72mf^2} i_o \frac{V}{V^{3/2}}$$

whence $$V^2 = \left(\frac{\pi e}{72mf^2 K}\right)^4 i_o^4$$

and $$P = \left(\frac{\pi e}{72mK}\right)^5 \frac{i_o^5}{f^{10}}$$

The ratio R by which the area of the beam may be converged from the area of the cathode is limited by design considerations to about a factor of 100. The beam current density $i_o$ is thus proportional to the cathode emission density $i_c$ $$i_o = R\, i_c$$

$$P = \left(\frac{\pi e R}{72mK}\right)^5 \frac{i_c^5}{f^{10}}$$

We see that the energy obtainable varies as the fifth power of the cathode emission density. Thus the improvement of at least a factor of two obtainable in tubes made according to the invention will allow an increase of 25 or 32 times the power output of prior-art tubes, when the design parameters are in the range where current density is a limiting feature. This is often the case at very high microwave frequencies, e.g. above 10 GHz. The extremely fast, tenth power dependence on frequency in the above equation should be noted. This further emphasizes that it is at high frequencies where emission is most critical.

It should be understood that all the advantages realizable from the invention cannot be obtained by simply replacing the cathode in a prior-art tube type. To utilize the increased emission the tube must be designed for it. In general, the voltage will be higher, requiring more insulation and stand-off capability. The power densities will be greater, requiring improved cooling. The electron-interaction dimensions such as drift tubes and interaction circuits have to be matched to the high-current electron stream.

Figure 7:
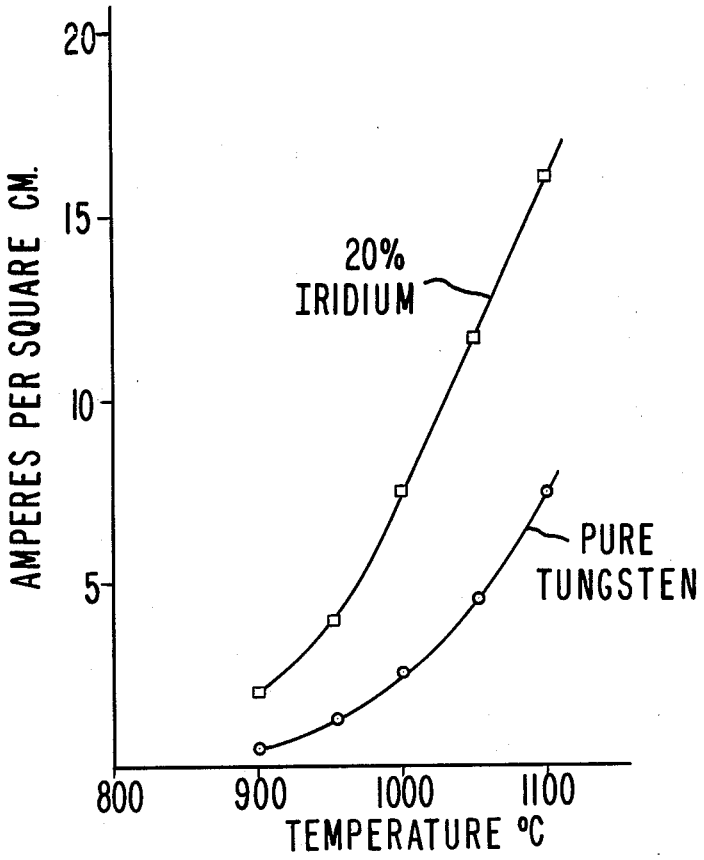
FIG. 7 is a graph of emission vs. temperature for old and new cathodes.

Returning now to FIG. 7, the graph shows available emission density in amperes per square centimeter vs cathode temperature in degrees C. The upper curve is data from a representative inventive cathode in which the metal matrix was 20% Ir and 80% W. The lower curve is from a cathode of identical dimensions comprising a pure tungsten matrix. The impregnating material in both cases is barium-calcium aluminate having a composition $Ba_x\ Ca_y\ Al\ O_z$. It is seen that with the inventive cathode over twice the emission is obtained at a given temperature. Alternatively, emission equal to that of a conventional cathode may be obtained at some 100 degrees lower temperature, with resulting improvement in tube life due to greatly reduced evaporation of active material and reduced heater temperature. Life tests on experimental tubes have been run over 2000 hours at 1100 degrees C with no impairment of emission and no indication of excessive evaporation.

Figure 8:
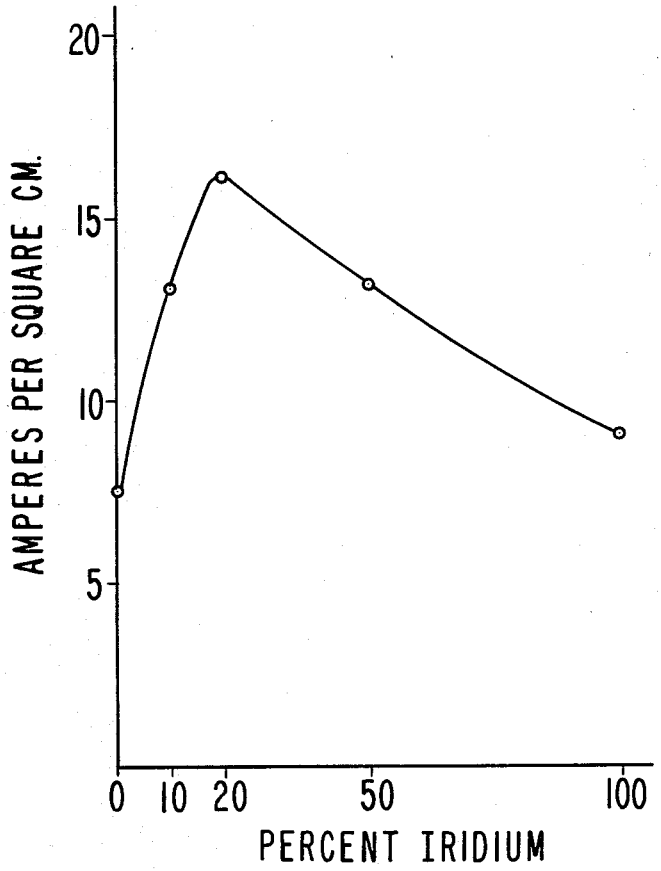
FIG. 8 is a graph of emission from cathodes of various compositions.

FIG. 8 is a graph of emission density at 1100 degrees C for a number of test cathodes having different weight proportions of iridium to tungsten. In all cases the metal particles were thoroughly mixed before pressing, so the distribution of iridium is presumed to be random. Contray to prior expectations, it was found that optimum emission was not from pure iridium. Rather, a maximum appears to occur at around 20% iridium. This surprising result is very beneficial because it reduces the amount of costly iridium needed while providing optimum emission.

The aforementioned embodiments are merely examples to illustrate the versatility of the invention. The true scope of the invention is intended to be limited only by the following claims and their legal equivalents.

What is claimed is:

1. An improved cathode for use in an electron tube for producing a high current density stream of electrons when heated, comprising a matrix of compacted metal particles formed with interstices therebetween which are substantially uniformly dispersed throughout the matrix and define therein an initial predetermined porosity, said matrix consisting of a mixture of metal particles of a first metal selected from the group of tungsten and molybdenum together with particles of a second metal selected from the group consisting of iridium, osmium, ruthenium and rhenium, said second metal particles comprising at least 10% to 90% by weight of said matrix, said matrix being compressed and treated to bring said particulate mixture into intimate particle-to-particle contact in which said particles are bonded together at regions of contact therein in which each metal component retains its discrete character and in which the interstices provide a substantial void volume throughout said matrix, and an electron emissive material comprising an alkaline earth aluminate including at least barium aluminate filling the interstices of said matrix to form therewith a solid cathode body of negligible porosity, said cathode body being formed with an electron emitting surface having a conformation which exposes the filled interstices and particulate matrix thereof to define, in operation, a plurality of exposed alkaline earth portions throughout the exposed surface of the mixture of matrix metal particles, said cathode being adapted for being heated to electron emitting temperature whereat the second metal and the alkaline earth aluminate interact during operation to reduce the work function for electron emission at said surface while the second metal is prevented from being sputtered away from said surface by its structural embodiment throughout the body of the cathode.

2. The improved cathode as in claim 1 further in which the interstices throughout the volume of said matrix comprise approximately 20% to 25% of the volume thereof.

3. The improved cathode of claim 1 in which said alkaline earth aluminate comprises calcium-barium aluminate.

4. An improved cathode as in claim 1 in which said second metal is iridium and in which the amount thereof consists of about 10% to 30% by weight of said matrix.

5. The improved cathode as in claim 2 in which said second metal of iridium is about 20% by weight of said matrix.

6. The improved cathode as in claim 3 in which said alkaline earth aluminate comprises calcium-barium aluminate.

7. In a microwave electron tube, an improved cathode for use therein for producing a high current density stream of electrons when heated, comprising a matrix of compacted metal particles formed with interstices therebetween which are substantially uniformly dispersed throughout the matrix and define therein an initial predetermined porosity, said matrix consisting of a mixture of metal particles of a first metal selected from the group of tungsten and molybdenum together with particles of a second metal selected from the group consisting of iridium, osmium, ruthenium and rhenium, said second metal particles comprising at least 10% to 90% by weight of said matrix, said matrix being compressed and treated to bring said particulate mixture into intimate particle-to-particle contact in which said particles are bonded together at regions of contact therein in which each metal component retains its discrete character and in which the interstices provide a substantial void volume throughout said matrix, and an electron emissive material comprising an alkaline earth aluminate including at least barium aluminate filling the interstices of said matrix to form therewith a solid cathode body of negligible porosity, said cathode body being formed with an electron emitting surface having a conformation which exposes the filled interstices and particulate matrix thereof to define, in operation, a plurality of exposed alkaline earth portions throughout the exposed surface of the mixture of matrix metal particles, said cathode being adapted for being heated to electron emitting temperature whereat the second metal and the alkaline earth aluminate interact during operation to reduce the work function for electron emission at said surface while the second metal is prevented from being sputtered away from said surface by its structural embodiment throughout the body of the cathode, means for heating said cathode to cause electron emission therefrom, an anode spaced from said cathode for accelerating the emitted electrons into an electron beam directed toward said anode, an interaction structure disposed in said tube to cause modulation of the electron beam at microwave frequencies, means for extracting microwave power from said tube.

8. The microwave tube as in claim 7 wherein said interaction structure is of the klystron type and said modulation is therefore velocity modulation.

9. The microwave tube as in claim 7 in which said second metal is iridium and in which the amount thereof consists of about 10% to 30% by weight of said matrix.

10. In an electron tube, an improved cathode for use therein for producing a high current density stream of electrons when heated, comprising a matrix of compacted metal particles formed with interstices therebetween which are substantially uniformly dispersed throughout the matrix and define therein an initial predetermined porosity, said matrix consisting of a mixture of metal particles of a first metal selected from the group of tungsten and molybdenum together with particles of a second metal selected from the group consisting of iridium, osmium, ruthenium and rhenium, said second metal particles comprising at least 10% to 90% by weight of said matrix, said matrix being compressed and treated to bring said particulate mixture into intimate particle-to-particle contact in which said particles are bonded together at regions of contact therein in which each metal component retains its discrete character and in which the interstices provide a substantial void volume throughout said matrix, and an electron emissive material comprising an alkaline earth aluminate including at least barium aluminate filling the interstices of said matrix to form therewith a solid cathode body of negligible porosity, said cathode body being formed with an electron emitting surface having a conformation which exposes the filled interstices and particulate matrix thereof to define, in operation, a plurality of exposed alkaline earth portions throughout the exposed surface of the mixture of matrix metal particles, said cathode being adapted for being heated to electron emitting temperature whereat the second metal and the alkaline earth aluminate interact during operation to reduce the work function for electron emission at said surface while the second metal is prevented from being sputtered away from said surface by its structural embodiment throughout the body of the cathode, means for heating said cathode to cause electron emission therefrom, an anode spaced from said cathode for accelerating said electrons into an electron beam directed toward said anode, means for controlling the movement of said electron beam.

11. The electron tube as in claim 10 in which said second metal is iridium and in which the amount thereof consists of about 10% to 30% by weight of said matrix.

* * * * *